US010814888B2

(12) United States Patent
Erharter et al.

(10) Patent No.: US 10,814,888 B2
(45) Date of Patent: Oct. 27, 2020

(54) PASSENGER CABLE TRANSPORTATION SYSTEM

(71) Applicant: Leitner S.P.A, Vipiteno (IT)

(72) Inventors: Nikolaus Erharter, San Candido (IT); Denis Ribot, Vipiteno (IT)

(73) Assignee: LEITNER S.P.A., Vipiteno (IT)

( * ) Notice: Subject to any disclaimer, the term of this patent is extended or adjusted under 35 U.S.C. 154(b) by 275 days.

(21) Appl. No.: 15/710,155

(22) Filed: Sep. 20, 2017

(65) Prior Publication Data

US 2018/0079431 A1 Mar. 22, 2018

(30) Foreign Application Priority Data

Sep. 21, 2016 (IT) ..... 102016000094933

(51) Int. Cl.

| | |
|---|---|
| ***B61B 12/00*** | (2006.01) |
| ***B61B 12/02*** | (2006.01) |
| ***B61B 1/02*** | (2006.01) |
| ***B61B 1/00*** | (2006.01) |
| ***B61B 7/00*** | (2006.01) |

(52) U.S. Cl.

CPC ..... *B61B 12/024* (2013.01); *B61B 1/00* (2013.01); *B61B 1/02* (2013.01); *B61B 7/00* (2013.01); *B61B 12/00* (2013.01)

(58) Field of Classification Search

CPC ..... B61B 1/02; B61B 12/024; B61B 12/00; B61B 7/00

USPC ..... 104/27, 28, 29, 30, 31

See application file for complete search history.

(56) References Cited

U.S. PATENT DOCUMENTS

| | | | | |
|---|---|---|---|---|
| 270,508 | A | 1/1883 | Terry | |
| 3,964,118 | A * | 6/1976 | Meyers | B64F 1/32 14/72.5 |
| 5,651,569 | A * | 7/1997 | Molnar | B60R 19/02 293/107 |
| 9,932,045 | B2 * | 4/2018 | Geddie | B61K 13/04 |
| 2016/0114813 | A1 * | 4/2016 | Richard | B61B 12/028 104/115 |

FOREIGN PATENT DOCUMENTS

| | | | |
|---|---|---|---|
| DE | 2712927 A1 * | 9/1978 | B61B 12/024 |
| DE | 2712927 A1 | 9/1978 | |

(Continued)

OTHER PUBLICATIONS

Italian Search Report and Written Opinion for Italian Application No. 201600094933 dated Apr. 24, 2017.

(Continued)

*Primary Examiner* — Scott A Browne

(74) *Attorney, Agent, or Firm* — Neal, Gerber & Eisenberg LLP

(57) ABSTRACT

A passenger cable transportation system, the cable system comprising: at least one cabin for transporting passengers; at least one station for passengers boarding and landing from the cabin; two lateral guides facing each other and configured to guide the cabin into the station along an advancing direction, wherein there is a clearance between the lateral guides and the cabin; and at least one blocking device configured to block the cabin in relation to the lateral guides at least along a direction transversal to the advancing direction level with at least one part of the station.

20 Claims, 4 Drawing Sheets

(56) References Cited

FOREIGN PATENT DOCUMENTS

| | | | | |
|---|---|---|---|---|
| DE | 2844623 | A1 | 9/1980 | |
| EP | 1034996 | A1 * | 9/2000 | ..... B61B 1/02 |
| FR | 2 546 836 | | 12/1984 | |
| FR | 2 752 803 | | 3/1998 | |
| JP | 1974-149448 | | 4/1973 | |
| JP | 1990-87669 | | 7/1990 | |
| JP | 2003-72538 | | 3/2003 | |
| JP | 4511073 | B2 | 7/2010 | |
| JP | 2013-95164 | | 5/2013 | |

OTHER PUBLICATIONS

Chinese Office Action for Application No. 201710858307.9 dated Apr. 2, 2020 (9 pages).
Notice of Opposition for European Patent No. EP3299243 dated Feb. 18, 2020 with English translation attached (100 pages).

* cited by examiner

FIG.5
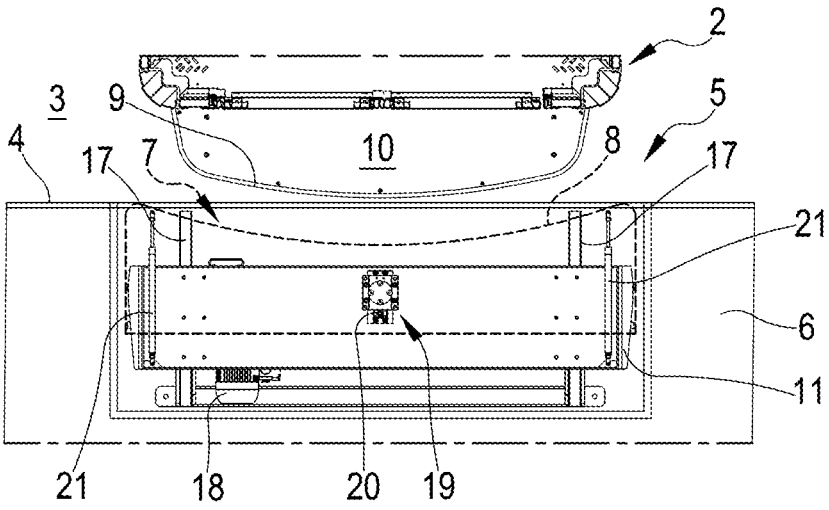
FIG.6
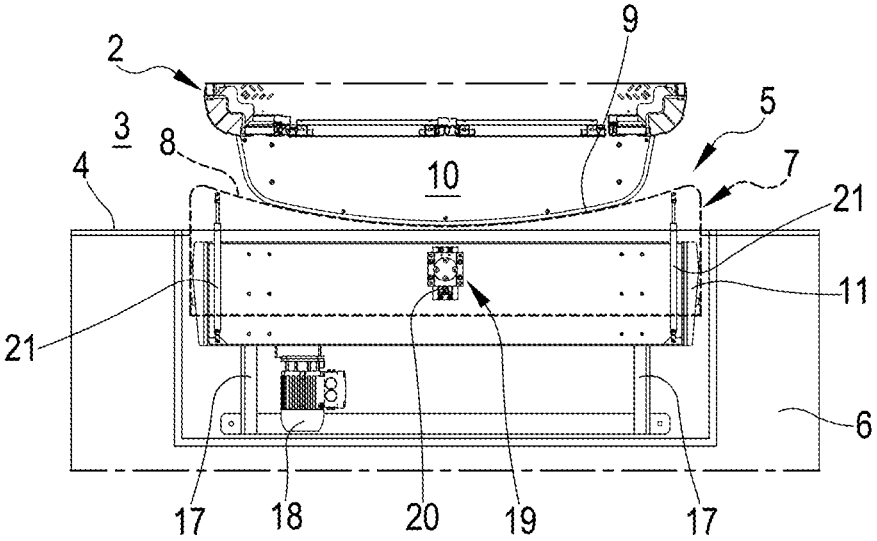
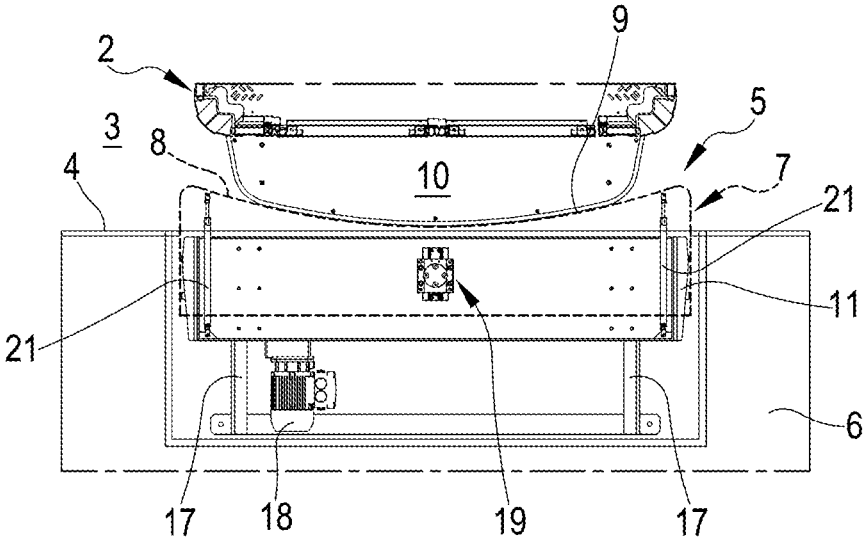
FIG.7

FIG.8
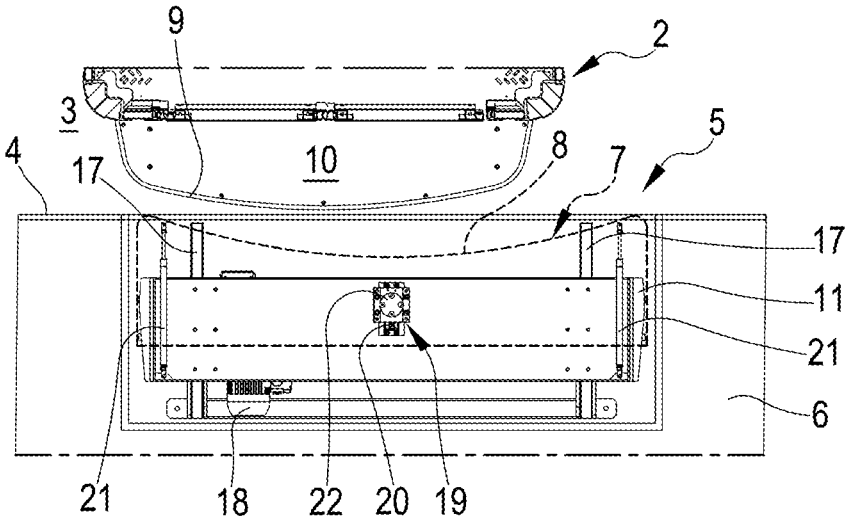
FIG.9
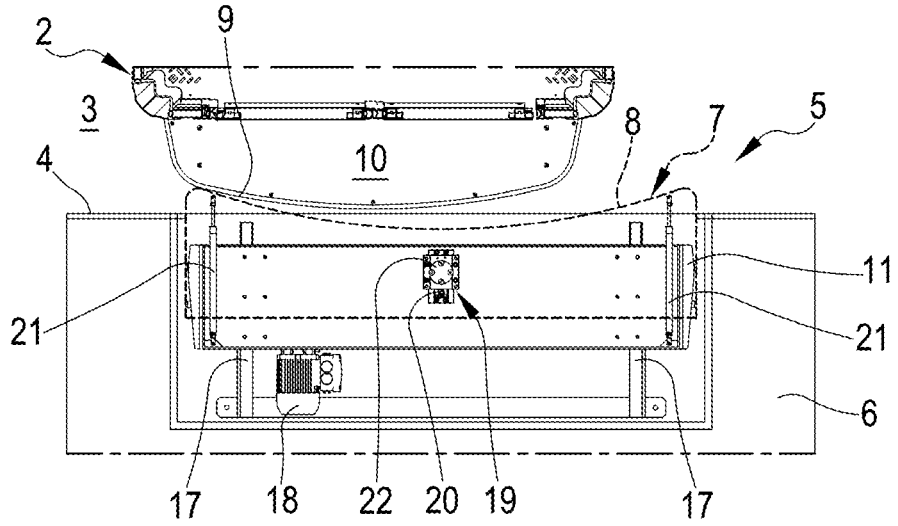
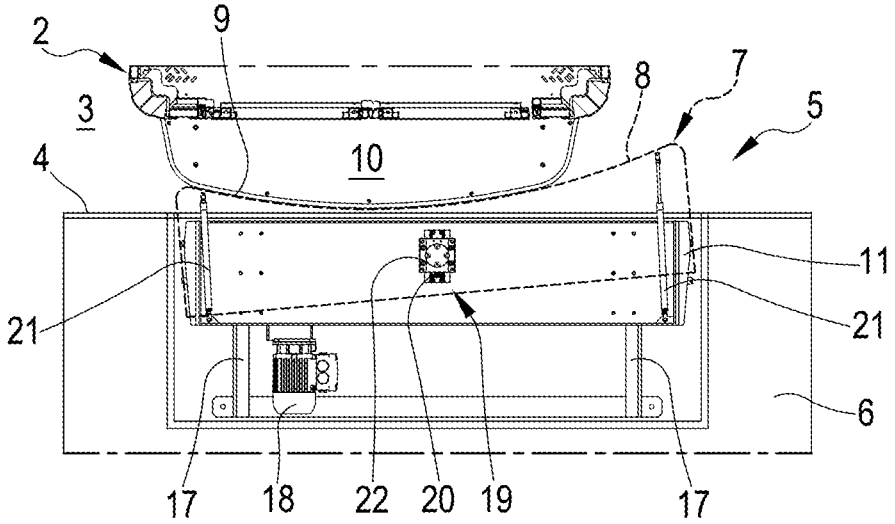
FIG.10

PASSENGER CABLE TRANSPORTATION SYSTEM

PRIORITY CLAIM

This application claims the benefit of and priority to Italian Patent Application No. 102016000094933, filed on Sep. 21, 2016, the entire contents of which are incorporated by reference herein.

TECHNICAL FIELD

The present disclosure relates to a cabin passenger cable transportation system.

BACKGROUND

Passenger cable transportation systems known as cable cars comprise cabins, which advance along a path hauled by a hauling cable wound around relative pulleys. The cabins are suspended along the path of the system to a supporting cable and/or to a hauling and supporting cable. The path of the system is defined by a series of supporting towers and extends between one upstream station and one downstream station.

At the upstream and downstream stations, as well as in other intermediate stations that may be planned along the path, passengers can board and land from the cabins by specific platforms.

At each platform, the system comprises two lateral guides configured to contain and guide the base of the cabin during the advancing of the cabin into the station. However, it is necessary to have a clearance between the cabin and the guides to keep the cabin at a sufficient distance to prevent the cabin from becoming stuck in the guides when advancing, particularly when the path defined by the guides is a curved path.

In said conditions (i.e., with the cabin suspended from the ground by a constraint positioned above the cabin and with a clearance present between the lateral guides and the cabin), oscillations are caused in the cabin by the passengers boarding and landing, particularly rolling oscillations, which make the cabin hit against the lateral guides.

Although in some cases along the stations the cabin is temporarily decoupled from the hauling cable, also in said part of the path, the cabin is always suspended from the ground, for example by a rail along which a roller supporting the clamp runs. Therefore, also in this case the above oscillating phenomenon occurs.

As stated previously, said oscillating movement consequently makes the cabin hit against the lateral guides generating an irritating noise and creating a sensation of instability and insecurity among the transiting passengers, especially those who do not travel frequently in cable cars.

Also providing that boarding and landing occurs without the cabin advancing, often in cable systems boarding and landing occurs with the cabin advancing, the clearance present between the cabin and the lateral guides remains and so also in this case the foregoing oscillating movement is created in the cabin.

SUMMARY

Consequently, it is an advantage of the present disclosure to realize a passenger cable transportation system, which overcomes certain of the previously highlighted drawbacks of certain of the prior art in a relatively simple and relatively inexpensive manner, both from a functional and constructional point of view.

To provide said advantages, the present disclosure relates to a passenger cable transportation system, wherein the cable system comprises:

- at least one cabin for passenger transportation;
- at least one station for passengers boarding and landing from the cabin; and
- two lateral guides facing each other and configured to contain and guide the cabin at at least one portion of the station.

Detailing the elements listed above, by cabin we mean a space that is at least partially isolated from the surrounding area, which is usually driven by a hauling cable and suspended above the ground. The suspension of the cabin can be achieved by a supporting cable, or directly by the hauling cable, to which a clamp is coupled projecting from the roof of the cabin.

As stated previously, at the stations, the cabin can be temporarily released from the supporting cable. However, also in this part of the path the cabin is suspended from the ground by a constraint positioned above the roof of the cabin, for example a rail where a roller supporting the clamp runs.

In a cable car, passengers land or board the cabins through specific side doors, which are usually automatic sliding doors. A footboard is commonly envisioned at said doors, outside the cabin, to assist boarding and landing, as well as spaces for putting skis, rackets and/or other objects usually carried by passengers.

Although seats may be foreseen inside the cabin, the unit of transport of the present disclosure must not be confused with a chairlift where no transport space is foreseen and wherein boarding occurs directly by sitting on the relative seat positioning oneself transversally on advancing.

By passenger cabin boarding and landing station we mean a fixed installation equipped with a plurality of structures configured to enable passengers to reach the boarding point relatively easily, for example by steps or ramps, and staying there safely, for example by platforms or waiting rooms.

The lateral guides are, in certain embodiments, made in form of substantially vertical metal banks, suitable for working with the lower portion of the cabins to guide and contain its movement inside the stations along an advancing direction. Said guides are usually U-shaped at the stations downstream and upstream in return systems, while they can present straight progressions in intermediate stations. However, in general, these lateral guides can have the desired progression depending on the path to be imposed on the cabin. The passenger boarding and landing platform is, in certain embodiments, an integral part of the upper edge of a lateral guide. A clearance, or distance transversal to the advancing direction is provided between the lateral guides and the cabin to prevent the cabin from becoming stuck in the lateral guides when advancing into the station.

According to the disclosure, the system comprises a blocking device configured to block the cabin with respect to the lateral guides at least along a direction transversal to the advancing direction at at least one portion of the station, such as at the passenger boarding and landing portion.

The expression blocking the cabin is not understood to mean the simple interruption of the advancing of the cabin, but a constraint to prevent lateral rolling oscillations, or oscillations transversal to the advancing, of the cabin.

Advantageously, in this way, passengers can board and land in a stable manner. That is, the blocking device keeps the cabin still in relation to the lateral guides along the direction orthogonal to the advancing direction, consequently preventing oscillations from the beginning, particularly rolling oscillations when passengers are boarding and landing.

The blocking device can be made, for example and only by way of example, in the form of a gripping device, or a clamp configured to selectively grip a portion of the cabin, or in the form of a pusher configured to selectively push the cabin in abutment against at least one lateral guide.

If the blocking device is in the form of a clamp, in certain embodiments, said clamp works with a fin portion projecting outside the cabin below the floor in a position substantially aligned with the suspension point of the cabin. Said clamp can be fixed in relation to the ground and/or lateral guides, or the clamp can be mounted onto a track or a slide to enable the continuous advancing of the cabin also during the gripping phases.

Advantageously, according to said embodiment of the disclosure with the blocking device in the form of a clamp positioned below the floor of the cabin, it is not necessary to make any modifications to the lateral guides present in the system.

In particular, according to an embodiment of the disclosure, the station comprises a passenger cabin boarding and landing platform and the pusher device is integrated into the platform or into the lateral guide positioned immediately below said platform. According to said embodiment, the blocking device can be made in the form of a pusher integrated into a portion of the platform or of the lateral guide connected to the pusher. According to said example, the pusher is able to selectively push the cabin against the opposite guide, moving from a retracted position, wherein the pusher does not hinder the advancing of the cabin and the pusher does not limit the clearance present between the lateral guides, to an extended position, which forces the cabin against the lateral guide opposite. Alternatively, the pusher can be integrated into the lateral guide opposite in relation to the one where boarding and landing is carried out.

Advantageously, according to said embodiment of the disclosure, with the blocking device in the form of a pusher integrated into a guide, it is not necessary to make any modifications to the cabins present in the system.

In particular, according to an alternative embodiment of the disclosure, the pusher device is integrated into the cabin. According to said embodiment, the pusher device is a portion of the cabin, for example in the form of a mobile footboard positioned immediately outside cabin door, and the pusher device can selectively push the cabin against the lateral guide moving from a retracted position, wherein the pusher device does not hinder the advancing of the cabin and the pusher device does not limit the clearance present between the lateral guides, to an extended position, which forces the cabin against the lateral guides.

Advantageously, said embodiment does not require any intervention in stations, which are currently already in use.

In particular, one embodiment of the pusher device can comprise a rigid pusher, mobile from a projecting position, wherein the pusher device pushes the cabin in abutment against at least one lateral guide, and a retracting position, wherein the cabin is free to advance between the guides. Said rigid pusher can, in certain embodiments, be of a translating type and comprises a pushing head, possibly shaped in a complementary manner to the corresponding surface on which the pusher acts. As stated previously, said rigid pusher can be integrated into the cabin or into the station inside the platform or a lateral guide.

Advantageously, thanks to a rigid pusher shaped in a complementary manner to the corresponding surface on which the pusher acts, the pushing force is evenly distributed along the whole contact area avoiding excessive local loading points, which could damage the structure of the cabin or the lateral guide.

In certain embodiments, the cabin comprises a footboard to assist passengers boarding and landing and the pusher device integrated in the platform and/or relative lateral guide is arranged in flush with the footboard.

Advantageously, in this case, the pusher creates a mobile platform, which, when extracted, creates a continuous floor for passengers in the absence of lights between the footboard and the mobile platform.

In particular, in the previously described embodiment, the pushing head and the corresponding surface on which the pushing head acts comprise shapes respectively concave and convex. If the pushing head is integrated inside the platform or a lateral guide, the surface on which the pushing head acts is a portion of the cabin, such as the footboard. If the pushing head is integrated inside the cabin the surface on which the pushing head acts is a portion of the platform or a lateral guide.

Advantageously, thanks to the geometric coupling between corresponding concave and convex surfaces, spontaneous centering of the cabin occurs in relation to the pusher.

In particular, the pushing head of the pusher device is mounted mobile, such as translating in a sprung manner, on a slide orthogonally translating in relation to the progression of the lateral guide. The pushing head and the slide are housed in the platform or in the lateral guide and are configured so that they are integral with each other until contact with the cabin. After contact, the slide is made to advance further in relation to the pushing head to generate a pushing force against the cabin, which derives from the partial compression of a spring present between the pushing head and the slide.

Advantageously, in this way, both the contact and pushing phase do not occur abruptly, but in a sprung manner without transmitting lateral impulses to the cabin.

In particular, in the embodiment just described, the pushing head can also be rotatable in relation to the slide, around an axis orthogonal to the platform in such a manner that also when the cabin is not centered in relation to the pushing head, the advancing movement of the slide after the initial contact with the cabin generates a rotation of the pushing head so that the pushing head adheres perfectly to the cabin.

In particular, according to an alternative embodiment, the pusher can comprise a deformable pusher for selective inflation, hydraulic or pneumatic, between an inflating configuration, wherein the pusher pushes the cabin in abutment against at least one lateral guide, and a deflating configuration, wherein the cabin is not pressed against the lateral guide.

Advantageously, in this way it is possible to achieve correct coupling between the pusher and the loading surface regardless of the geometric shapes present.

All of the embodiments described thus far, which include a pusher, can of course be used envisioning the temporary stopping of the cabin in the station during operation of the pusher device.

However, the present disclosure also envisions the option of the continuous advancing of the cabin in the station also during operation of the pusher device.

In particular, the pusher device and the lateral guides can, in certain embodiments, be configured to enable the continuous movement of the cabin in the station also in the part in the cabin that is pressed against the lateral guide. For example, the contact surface between the cabin and the lateral guides and the surface between the cabin and the pusher device can comprise a band or a mobile belt or they can comprise rolling rollers.

Advantageously, according to said embodiment, the cabin is not necessarily stopped and, at the same time, the development of oscillations is prevented.

In particular, according to one embodiment of the disclosure, the system can comprise a couple of pusher devices acting on both sides of the cabin.

Advantageously, according to said embodiment of the disclosure, the cabin is centred in the guides and the floor inside the cabin is kept horizontal.

Additional features and advantages are described in, and will be apparent from, the following Detailed Description and the Figures.

BRIEF DESCRIPTION OF THE DRAWINGS

Further characteristics and advantages of the present disclosure will become clear from the following description of an example of an embodiment, which is not limiting, with reference to the Figures in the accompanying drawings, wherein:

FIGS. 5 to 10 schematically show operating phases of the passenger cable transportation system, wherein the boarding and landing platform is equipped with the pusher according to FIG. 3.

DETAILED DESCRIPTION

Figure 1:
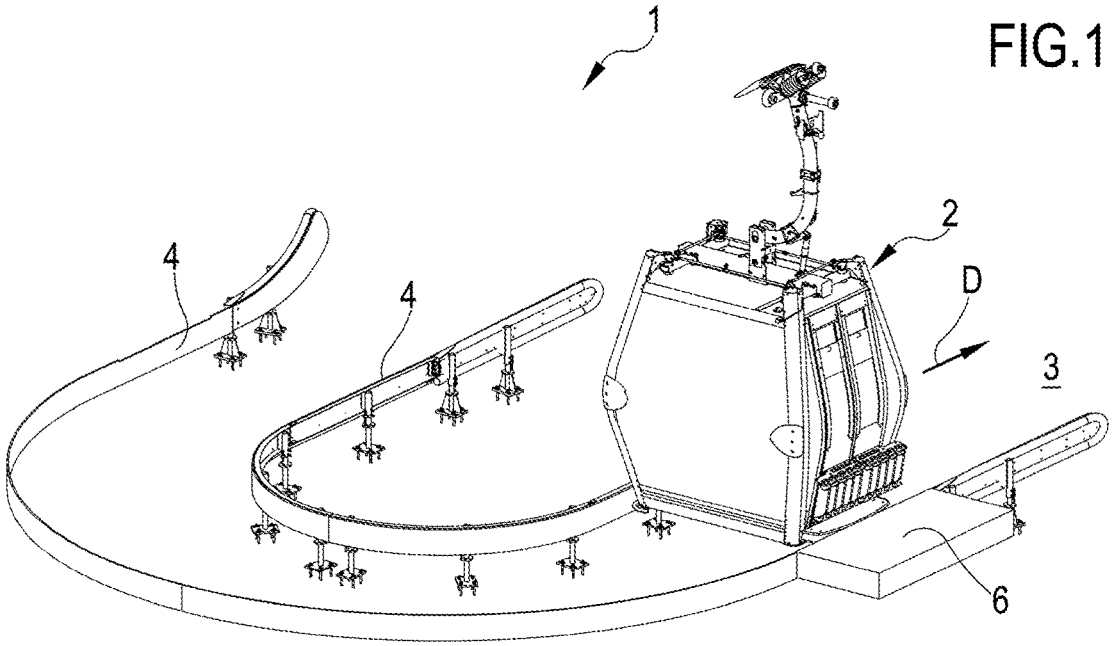
FIG. 1 is a perspective schematic view of a passenger boarding and landing station of a passenger cable transportation system.

Referring now to the example embodiments of the present disclosure illustrated in FIGS. 1 to 10, FIG. 1 shows a perspective schematic view of a passenger boarding and landing station 3 of a cabin 2 passenger cable transportation system 1. The station 3 comprises a couple of lateral guides 4 configured to contain and guide the cabin along the advancing direction D in the station 3. In FIG. 1, the path, in plan view, of the guides is U-shaped and the station 3 can be a upstream or downstream station, where the cabin 2 inverts the direction of travel in a U. FIG. 1 also shows a platform 6, arranged along a part of the outer guide 4 where passengers board and land.

Figure 2:
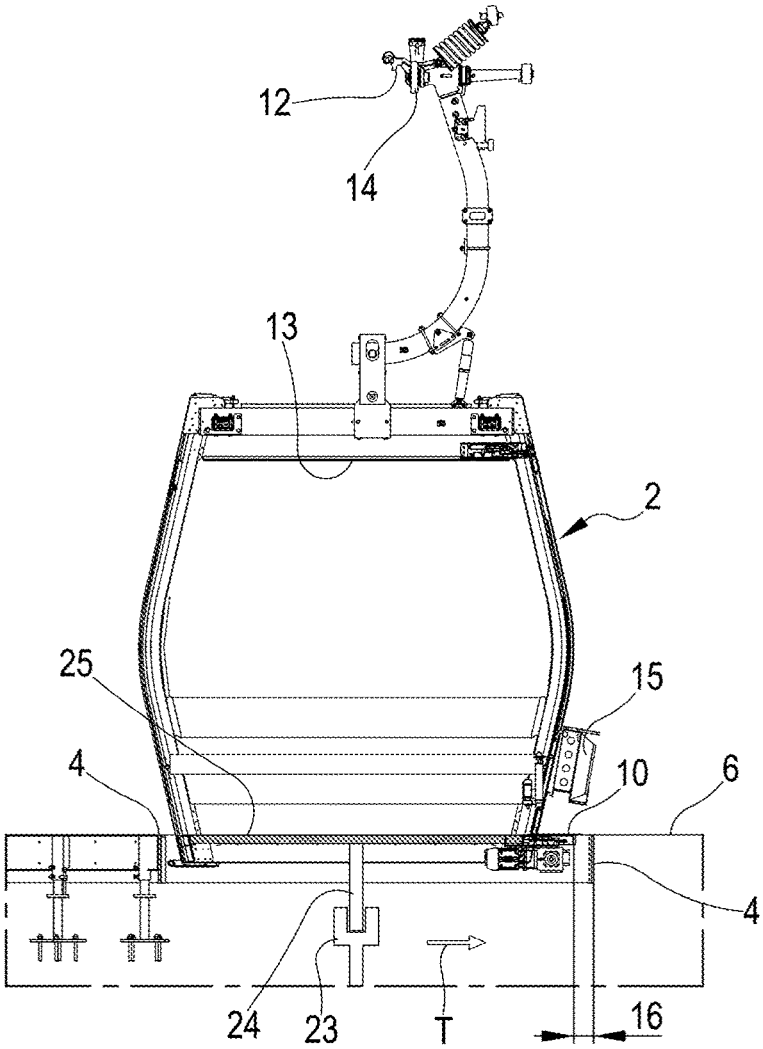
FIG. 2 is an enlarged schematic view of the cabin in FIG. 1 along the advancing direction, wherein an embodiment of a blocking device is visible according to the present disclosure in the form of a lower clamp.

FIG. 2 is a view of the cabin 2 along the advancing direction D and shows the arrangement of the cabin 2 in detail in relation to the lateral guides 4 at the passenger boarding and landing platform 6.

When advancing, as we know, the cabin 2 is suspended from the ground by an upper clamp 12 constrained to a cable (not shown) positioned above the roof 13 of the cabin 2. If the clamp 12 were to be released from the cable in the station 3, the cabin 2 is nonetheless suspended thanks to a roller 14 carrying the clamp 12 that rolls on a rail (not shown) positioned above the roof 13 of the cabin 2. The cabin 2 shown in FIG. 2 also comprises a footboard 10 configured to assist passengers with boarding and landing, arranged outside the cabin entrance and exit door (not shown). Said footboard 10 is substantially in flush with the platform 6 or with the upper edge of the lateral guide 4. As we know, the cabin 2 is also equipped with an outside space 15 where passengers can put skis, rackets or other accessories.

As we can see in FIG. 2, the lateral guides 4, at least level with the passenger boarding and landing part, have a distance between them that is slightly greater than the width of the cabin 2 in order to contain the cabin and guide the cabin, without blocking the cabin. Said transversal clearance is represented in FIG. 2 by reference number 16 and is schematized as the distance present between the footboard 10 of the cabin 2 and the lateral guide 4 supporting the platform 6.

FIG. 2 shows a first embodiment of the blocking device of the present disclosure configured to block the cabin 2 in relation to the lateral guides 4 at least along a direction T transversal to the advancing direction D level with at least one part of the station 3. In particular, FIG. 2 shows a blocking device in the form of a lower clamp 23 (only outlined), which acts against a fin portion 24, projecting at the bottom outside the cabin 2 below the floor 25. In said Figure, the lower clamp 23 is shown fixed and planted in the ground. However, the clamp can be fixed to a lateral guide 4 and/or the clamp can be housed on a slide or a guide parallel to the advancing direction D so as not to stop the advancing of the cabin 2. The lower clamp 23 can move, in a known manner, from an initial configuration of free insertion of the fin portion 24 in the mouth of the clamp 23 to a second configuration, wherein the mouth of the clamp 23 is clamped to hold the fin portion 24. In said last configuration, even though the clearance 16 is still present, the movement along the transversal T direction or rolling rotations of the cabin 2 are prevented from the start. In FIG. 2, the lower clamp 23 is substantially aligned with the upper clamp 12. However, the position of the clamp 23 can be different to the position shown as long as the clamp prevents movement along the transversal T direction or rolling rotations of the cabin 2.

FIGS. 3 to 10 show an alternative or complementary embodiment of the blocking device of the present disclosure. In particular, FIGS. 3-10 show a blocking device in the form of a pusher configured to selectively push the cabin 2 in abutment against at least one lateral guide 4.

Figure 3:
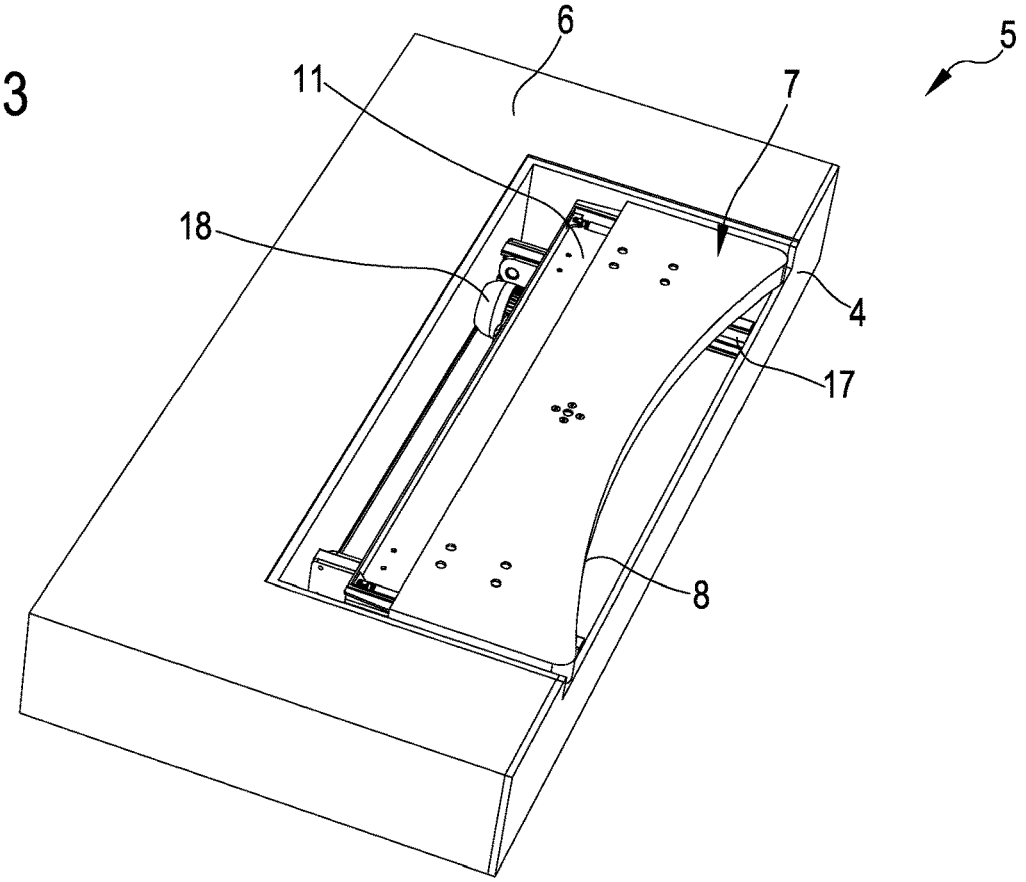
FIGS. 3 and 4 show schematic views of an embodiment of a blocking device according to the present disclosure in the form of a pusher.

FIG. 3 shows a broken view of an embodiment of the disclosure, which envisions a pusher 5 integrated into the platform 6, in the form of a rigid pusher 7. It should be appreciated that FIG. 3 is a non-limiting example of the disclosure, according to which, for example, the pusher device 5 could be of a different type, for example not rigid but inflatable, or it could be integrated into the cabin 2, for example in the footboard 10 or in the lateral guide 4 opposite the platform 6.

The rigid pusher 7 in FIG. 3 comprises a pushing head 8 facing the footboard 10 and a slide 11 onto which the pushing head 8 is mounted sprung and mobile, both in translation and in rotation. In said example, the pusher 5 is completely integrated with the platform 6 so that during the resting phases, it is hidden beneath the platform 6, not projecting from the lateral guide 4. The slide 11 is mounted onto tracks 17 (only partially visible) that are orthogonal to the lateral guide 4 and it is driven by a special motor 18.

Figure 4:
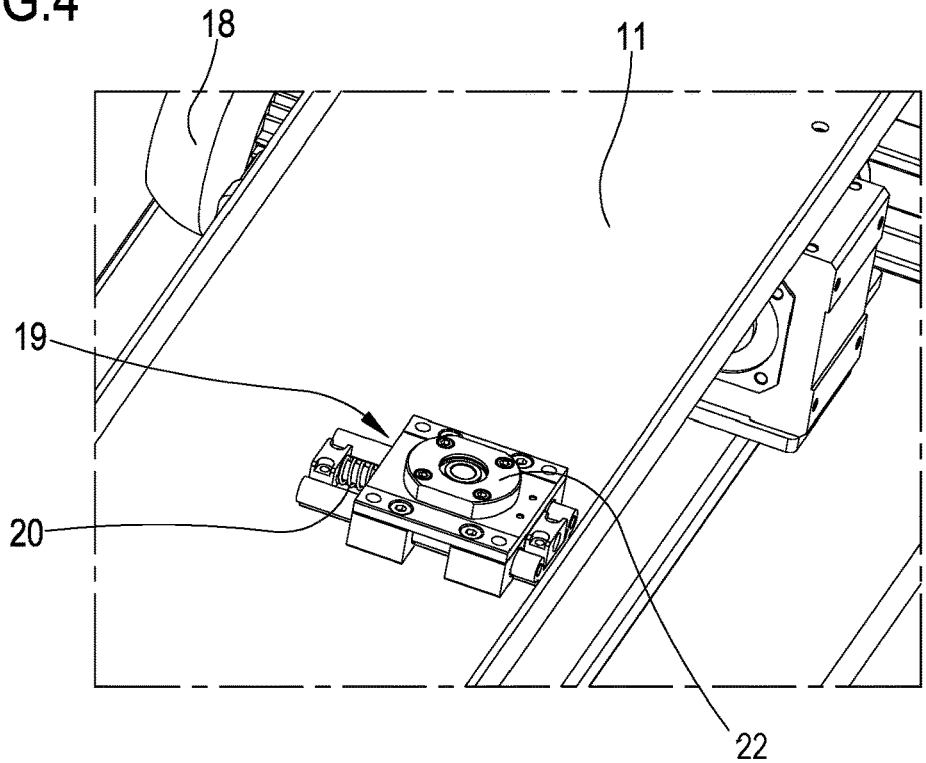

FIG. 4 shows how the pushing head 8 is connected to the slide 11 according to said embodiment. In particular, a sliding block coupling 19 is put between the slide 11 and the pushing head 8, fitted with a preloaded spring 20. Said coupling is consequently configured so that until the first contact of the pushing head 8 with the footboard 10, the spring 20 keeps the pushing head 8 integral with the slide 11. After the first contact, and during the initial pushing phase of the cabin 2, the slide 11 advances even further while the pushing head 8 stays still against the footboard 10. This further advancing of the slide 11 results in the compression of the spring 20, which generates a corresponding pushing force on the cabin 2 that is then blocked against the lateral guide opposite 4. Again, in FIG. 4 we can see how the pushing head 8 is connected to the sliding block 19 by a rotating plate 22, which enables the pushing plate 8 to rotate in relation to the slide 11 around an axis orthogonal to the platform 6.

FIGS. 5 to 10 show operating phases of the pusher 5 in FIG. 3 in two different conditions. The pushing head 8 is represented by a dotted pattern for clarity in these Figures, also to highlight the movements of the slide 11 positioned below the pushing head 8. In particular, FIGS. 5 to 7 show the state, wherein the cabin 2 is centered in relation to the pushing head 8 of the pusher device 5.

FIG. 5 outlines an initial phase wherein, after crossing part of the station 3, the cabin 2 comes level with the passenger boarding and landing platform 6. The advancing of the cabin 2 to the platform 6 is guaranteed by the presence of the clearance 16 present between the footboard 10 and the lateral guide 4. According to this example, the cabin 2 is stopped level with the center of the pushing head 8 and then the pusher device 5, hidden in the platform 6, is activated.

FIG. 6 shows an intermediate phase, wherein the pushing head 8 comes into contact with the footboard 10 of the cabin. In particular, during the approaching movement the pushing head 8 moves integrally with the slide 11, which is driven, in turn, by the motor 18 along the guides 17.

After contact between the pushing head 8 and the footboard 10, the cabin 2 comes into contact with the lateral guide 4 positioned on the opposite side in relation to the footboard 10, preventing the pushing head 8 from advancing. In this state, the motor 18 is configured and controlled so as to enforce a further advancing on the slide 11, which then translates in relation to the pushing head 8 thanks to the sprung sliding block 19. Said further advancing results in the compressing of the spring 20 that reacts by transferring the load to the pushing head 8, which transmits it, in turn, to the cabin 2 through the footboard 10.

FIG. 7 outlines this last phase wherein the spring 20 is compressed. The relative movement of the slide 11 in relation to the pushing head 8 is further guided by a couple of telescopic arms 21 having ends connected to the pushing head 8 and the slide 11 respectively.

FIGS. 8 to 10 show operating phases of the pusher 5 in FIG. 3, wherein the cabin 2 is nonetheless stopped with the footboard 10 not centered in relation to the pushing head 8 of the pusher device 5.

FIG. 8 outlines an initial phase, wherein, after crossing part of the station 3, the cabin 2 comes level with the passenger boarding and landing platform 6. The advancing of the cabin 2 towards the platform 6, as described previously, is guaranteed by the clearance 16 present between the footboard 10 and the lateral guide 4.

FIG. 9 shows an intermediate phase, wherein the pushing head 8 comes into contact with the footboard 10 of the cabin. As the footboard 10 is not centred in relation to the pushing head 8, said initial contact does not take place level with the whole surface of the pushing head 8, but only along a short part of the surface of the pushing head, or only in a lateral point. As with the previous example, during the approaching movement, the pushing head 8 moves integrally with the slide 11 driven, in turn, by the motor 18 along the guides 17.

The subsequent advancing of the slide 11 makes the pushing head 8 rotate around the rotating plate 22, coupling the whole front surface of the footboard 10 with the pushing head 8. The telescopic rods 21 are hinged to the pushing head 8 and slide 11 so as to guide said rotation of the pushing head 8 in relation to the slide 11.

Said rotation, and the subsequent advancing of the slide 11, result in the compression of the spring 20, which, as in the previous case, reacts by transferring the load to the pushing head 8, transmitting the load, in turn, to the cabin 2 through the footboard 10.

FIG. 10 outlines said last phase, wherein the pushing head 8 is inclined to couple along the whole development of the footboard 10 with the spring 20 is compressed.

Finally, it is clear that modifications and variations can be made to the passenger cable transportation system described here without going beyond the scope of the accompanying claims. Accordingly, various changes and modifications to the presently disclosed embodiments will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A passenger cable transportation system comprising:

a passenger station;

two U-shaped lateral guides facing each other and configured to guide a cabin along an advancing direction into the passenger station where the cabin traverses the advancing direction in a U-shape, wherein a clearance is defined between the U-shaped lateral guides and the cabin; and at least one blocking device comprising a pusher that is at least one of: integrated in a platform of the passenger station and in a first one of the U-shaped lateral guides associated with at least one part of the passenger station, wherein when the cabin is stopped from advancing at the passenger station, the pusher is configured to selectively push the cabin in abutment against a second one of the U-shaped lateral guides to block oscillations of the cabin in relation to the U-shaped lateral guides at least along a direction transversal to the advancing direction and a cabin pushing surface of the pusher is moveable from a retracted position substantially within a vertical wall of the at least one of the platform and the first one of the U-shaped lateral guides to a projecting position wherein the cabin pushing surface of the pusher is in contact with a portion of the cabin.

2. The passenger cable transportation system of claim 1, wherein in the projecting position, the pusher is configured to push the cabin in abutment against the second one of the U-shaped lateral guides and in the retracted position, the cabin is free to advance between the U-shaped lateral guides.

3. The passenger cable transportation system of claim 1, wherein the pusher comprises a pushing head defining an outer profile complementarily shaped to an outer profile of a surface on which the pusher head acts.

4. The passenger cable transportation system of claim 3, wherein the pushing head defines a concave shape and the surface on which the pusher head acts defines a convex shape.

5. The passenger cable transportation system of claim 4, wherein the pushing head is sprung and moveably mounted on a slide configured to orthogonally translate in relation to one of the U-shaped lateral guides such that the pushing head and the slide are integral with each other until contact with the cabin occurs, and after contact with the cabin occurs, the slide is configured to advance in relation to the pushing head to generate a pushing force against the cabin.

6. The passenger cable transportation system of claim 5, wherein the pushing head is rotatable in relation to the slide such that when the cabin is not centered in relation to the pushing head, the advancement of the slide generates a rotation of the pushing head so that the pushing head engages to the cabin.

7. The passenger cable transportation system of claim 1, wherein the pusher comprises a deformable pusher configured to be selectively inflated to an inflating configuration in which the pusher pushes the cabin in abutment against the second one of the U-shaped lateral guides.

8. The passenger cable transportation system of claim 1, wherein the cabin comprises a footboard and the pusher is configured to be positioned flush with the footboard.

9. The passenger cable transportation system of claim 1, wherein the pusher and the U-shaped lateral guides are configured to enable a continuous advancing of the cabin into the passenger station.

10. The passenger cable transportation system of claim 1, wherein the blocking device comprises another pusher configured to selectively push the cabin in abutment against the second, opposite one of the U-shaped lateral guides.

11. A passenger cable transportation system blocking device comprising:

a pusher that is at least one of: integrated in a platform of a passenger station and in a first one of two U-shaped lateral guides associated with at least one part of the passenger station, wherein the two U-shaped lateral guides face each other to guide a cabin along an advancing direction into the passenger station where the cabin traverses the advancing direction in a U-shape and when a clearance is defined between the U-shaped lateral guides and the cabin is stopped from advancing at the passenger station, the pusher is configured to selectively push the cabin in abutment against a second one of the two U-shaped lateral guides to block oscillations of the cabin in relation to the U-shaped lateral guides at least along a direction transversal to the advancing direction and a cabin pushing surface of the pusher is moveable from a retracted position substantially within a vertical wall of the at least one of the platform and the first one of two U-shaped lateral guides to a projecting position wherein the cabin pushing surface of the pusher is in contact with a portion of the cabin.

12. The passenger cable transportation system blocking device of claim 11, wherein in the projecting position, the pusher is configured to push the cabin in abutment against the second one of the U-shaped lateral guides and in the retracted position, the cabin is free to advance between the U-shaped lateral guides.

13. The passenger cable transportation system blocking device of claim 11, wherein the pusher comprises a pushing head defining an outer profile complementarily shaped to an outer profile of a surface on which the pusher head acts.

14. The passenger cable transportation system blocking device of claim 13, wherein the pushing head defines a concave shape and the surface on which the pusher head acts defines a convex shape.

15. The passenger cable transportation system blocking device of claim 14, wherein the pushing head is sprung and moveably mounted on a slide configured to orthogonally translate in relation to one of the U-shaped lateral guides such that the pushing head and the slide are integral with each other until contact with the cabin occurs, and after contact with the cabin occurs, the slide is configured to advance in relation to the pushing head to generate a pushing force against the cabin.

16. The passenger cable transportation system blocking device of claim 15, wherein the pushing head is rotatable in relation to the slide such that when the cabin is not centered in relation to the pushing head, the advancement of the slide generates a rotation of the pushing head so that the pushing head engages to the cabin.

17. The passenger cable transportation system blocking device of claim 11, wherein the pusher comprises a deformable pusher configured to be selectively inflated to an inflating configuration in which the pusher pushes the cabin in abutment against the second one of the U-shaped lateral guides.

18. The passenger cable transportation system blocking device of claim 11, further comprising another pusher configured to selectively push the cabin in abutment against the first one of the U-shaped lateral guides.

19. A passenger cable transportation system blocking device comprising:

a substantially U-shaped clamp associated with at least one part of a passenger station, such that when a clearance is defined between two U-shaped lateral guides and a cabin is stopped advancing at the passenger station, the clamp is configured to grip, at least along a direction transversal to an advancing direction, a portion of the cabin in relation to the two U-shaped lateral guides, wherein the two U-shaped lateral guides face each other and are configured to guide the cabin along the advancing direction into the passenger station where the cabin traverses the advancing direction in a U-shape.

20. The passenger cable transportation system blocking device of claim 19, wherein the clamp is configured to selectively grip a fin portion projecting outside the cabin below a floor of the cabin.

* * * * *